US006045656A

United States Patent [19]

Foster et al.

[11] Patent Number: 6,045,656

[45] Date of Patent: Apr. 4, 2000

[54] PROCESS FOR MAKING AND DETECTING ANTI-COUNTERFEIT PAPER

[75] Inventors: James Joseph Foster, Clifton Forge; Leo Thomas Mulcahy, Covington, both of Va.

[73] Assignee: Westvaco Corporation, New York, N.Y.

[21] Appl. No.: 09/216,765

[22] Filed: Dec. 21, 1998

[51] Int. Cl.[7] ..... D21F 11/00

[52] U.S. Cl. ..... 162/140; 162/158; 162/162; 162/183; 162/141

[58] Field of Search ..... 162/140, 134, 162/135, 137, 162, 158, 183, 181.1, 181.8, 184, 185, 9, 182, 141; 283/72, 89, 92; 428/206, 207, 195, 211, 916

[56] References Cited

U.S. PATENT DOCUMENTS

| | | | |
|---|---|---|---|
| 34,634 | 3/1862 | Hayward | 162/140 |
| 210,497 | 12/1878 | Casilear | 162/140 |
| 282,106 | 7/1883 | Musil | 162/140 |
| 322,130 | 7/1885 | Schreiber | 162/140 X |
| 322,131 | 7/1885 | Schreiber | 162/140 X |
| 2,089,293 | 8/1937 | Paine et al. | 162/140 |
| 2,379,443 | 7/1945 | Kantrowitz et al. . | |
| 3,029,181 | 4/1962 | Thomsen | 162/181.2 |
| 3,767,516 | 10/1973 | Brady . | |
| 4,028,118 | 6/1977 | Nakasyji et al. . | |
| 4,037,007 | 7/1977 | Wood . | |
| 4,120,445 | 10/1978 | Carrier et al. | 229/53 |
| 4,273,362 | 6/1981 | Carrier et al. | 283/95 |
| 4,437,935 | 3/1984 | Crane, Jr. . | |
| 4,496,961 | 1/1985 | Devrient . | |
| 4,510,020 | 4/1985 | Green et al. | 162/169 |
| 4,863,783 | 9/1989 | Milton | 428/207 |
| 4,983,256 | 1/1991 | Combette et al. . | |
| 5,058,925 | 10/1991 | Dotson . | |
| 5,074,962 | 12/1991 | Ishigaki et al. . | |
| 5,096,539 | 3/1992 | Allan | 162/9 |
| 5,143,583 | 9/1992 | Marchessault et al. | 162/138 |
| 5,223,090 | 6/1993 | Klungness et al. | 162/9 |
| 5,264,081 | 11/1993 | Honnorat et al. . | |
| 5,275,699 | 1/1994 | Allan et al. | 162/181.2 |
| 5,425,978 | 6/1995 | Berneth et al. . | |
| 5,565,276 | 10/1996 | Murakami et al. | 428/537.5 |
| 5,759,349 | 6/1998 | Foster et al. . | |

FOREIGN PATENT DOCUMENTS

| | | |
|---|---|---|
| 2 478 695 | 9/1981 | France . |
| 442530 | 2/1936 | United Kingdom . |
| 1420154 | 1/1976 | United Kingdom . |
| 1455122 | 11/1976 | United Kingdom . |
| 1466102 | 3/1977 | United Kingdom . |

OTHER PUBLICATIONS

"How they make papers in Sweden," Paper Aug. 6, 1979 (vol. 192 No. 3 1979).

"Security papers today," Paper Europe Oct. 1994.

Sakar in "Fluorescent Whitening Agents," Merrow Publishing Co. LTD, pp 12–50, Jan. 1971.

Crouse et al., "Fluorescent Whitening Agents in the Paper Industry," Tappi, vol. 64, No. 7, pp 87–89, Jul. 1981.

*Primary Examiner*—Jose Fortuna
*Attorney, Agent, or Firm*—J. R. McDaniel; R. L. Schmalz

[57] ABSTRACT

This invention relates to a method for producing anti-counterfeit paper. Such processes of this type, generally, add a certain percentage of wood fiber lumens which have been loaded with one or more fluorescent agents. These wood fiber lumens would look normal under regular light, but will glow when exposed to various manners of radiation.

7 Claims, No Drawings

PROCESS FOR MAKING AND DETECTING ANTI-COUNTERFEIT PAPER

BACKGROUND OF THE INVENTION

1. Field of the Invention

This invention relates to a method for producing anti-counterfeit paper. Such processes of this type, generally, add a certain percentage of wood fiber lumens which have been loaded with one or more fluorescent agents. These wood fiber lumens would look normal under regular light, but will glow when exposed to various manners of radiation.

2. Description of the Related Art

Traditionally, counterfeiting has been associated with the illicit production of currency. Today, however, there is a significant loss to manufacturers by counterfeiting of software, compact discs, cigarettes, video tapes, etc. This type of counterfeiting costs companies millions of dollars of lost revenue. Furthermore, these counterfeit items are usually made cheaply, thereby causing an unsuspecting consumer to question the manufacturers' quality.

Without a doubt, it is in the best interest of a company to eliminate counterfeit products, from an economic and public perception point of view.

Manufacturers have several different options at their disposal to combat counterfeiting. These include watermarks, specialized printing, the use of holographic labels, the use of synthetic fibers or additives, etc. These anti-counterfeiting techniques are described below.

Watermarks consist of impressing a design into the wet fiber web prior to couching the paper. Since this process is done early in the process, it arranges some of the fiber within the paper. This arranging of the fiber makes watermarks difficult to counterfeit.

Watermarks are used extensively in United States and European currencies and security documents. Other inventors have worked to increase the security of the watermarking process by controlled deposition of the fiber during the paper forming process and placing individual, unique watermarks on each piece of paper.

The use of watermarks is ideally suited for thin papers such as currencies, bank checks, etc., which are translucent. Unfortunately, the use of watermarks on thick papers and paperboard is of less utility because of the low transmission of light. A watermark on these thicker papers would not be readily apparent as in thinner, translucent papers.

Complicated printing techniques have also been traditionally used in security documents and currencies. These are typically lifelike portraits and intricate designs. Additionally, specialty inks, blended exclusively for these enduses, have extensive use in the security document sector. These specialty inks include everything from using multiple colors, to the use of high intensity ultraviolet light to create a pattern fluorescing in visible or ultraviolet light. However, the advent of high quality, color photocopiers have made the use of special ink colors and intricate designs less of a barrier to the counterfeiter.

In response to the increased ingenuity of the counterfeiters, microprinting was developed. Microprinting is a technique where messages, etc., are finely printed on a material. To the naked eye, the messages appear to be a simple line, but under magnification, the messages are revealed. This technique makes counterfeiting of the material more troublesome because the printing technique is difficult to do. However, the drawback to this microprinting technique is that it is relatively easy to acquire a printing press. Also, one can set up this printing equipment anywhere and keep it well hidden.

Holographic labels are also used extensively as an anti-counterfeit device. These labels have an image impressed into them which changes dependant on the point of view. A familiar example of these labels is the shiny image on credit cards. While these are effective as an anti-counterfeit device, they are expensive to produce and keep track of.

Placing dyed synthetic fibers into the printing substrate has been practiced for many years as an anti-counterfeit device. A common example is the paper used for US currency which has blue and red synthetic fibers in it. Though effective, it has a significant drawback because it can only be used in specific applications. For example, currency paper would not be suitable for general printing because the dyed synthetic fibers would detract from the images and/or printing.

Also, the related art contains references to planchettes which are tiny disks that appear on the paper. The disks are usually made from wet strength paper, however, plastic is sometimes used. The planchettes can be visible, invisible, ultraviolet responsive, etc. Additionally, the planchettes can be formulated to contain a portion of a color changing compound then incorporated into the paper. When the second portion of the color changing compound is applied, the planchettes change colors. Exemplary of such prior art is U.S. Pat. No. 4,037,007 ('007) to W. A. Wood, entitled "Document Authentification Paper".

While planchettes are an effective anti-counterfeiting measure, they do have several drawbacks. The primary one is that they can interfere with the printing process. Many inks used in the printing process are tacky. This tackiness can pull-off loose planchettes, thereby, causing a poor print. If this happens, the press must be stopped to clean up the loose planchettes.

Finally, some manufacturers have used fibers dyed with a fluorescent agent. These fibers are not readily apparent under normal light, however, under ultraviolet light these fibers glow. Exemplary of such prior art is U.S. Pat. No. 2,379,443 ('443), entitled "Process of Manufacturing Identifiable Paper", by Kantrowitz et al.

While the '443 patent describes a process whereby a percentage of chemically treated fibers are dispersed into fiber furnish prior to the papermaking process, the chemically treated fibers are indistinguishable from normal fibers until the paper is treated with a solution which reacts with the chemically treated fibers to produce an irreversible color change.

While the '443 patent describes the use of ultraviolet radiation as a means to cause chemically treated fibers to fluoresce, there are two major differences between the '443 patent and the present invention. The first such difference is that the present invention uses a lumen loading technique, which will be described later, to place the fluorescent material or dye inside the fiber. The technique of the present invention also includes rinsing the excess fluorescent material from the outside of the fiber. The lumen loading technique of the present invention is performed to trap/contain the fluorescent materials inside the fiber thereby minimizing the amount of dye migrating from the paper.

Minimizing the migration of these materials is important for certain enduses such as pharmaceutical and food packaging. The reason is that fluorescent materials usually have some toxicity associated with them and, therefore, the excess exposure to the consumer should be keep to a minimum. By trapping/containing the fluorescent materials inside the fiber, it reduces the potential migration from the paper and into the drug or food being packaged, thereby reducing exposure to a toxic substance.

Even in other enduses where the potential for transfer of fluorescent material is low, it is always beneficial to minimize one's exposure to toxic compounds. Examples of these enduses include security papers, such as checks, banknotes, etc.

The second major difference between the 1443 patent and the present invention is that the '443 patent only discloses the use of materials that fluoresce when exposed to ultraviolet radiation. In contrast, the present invention discloses the use of materials that fluoresce under all manner of radiation, including, but not limited to, ultraviolet and infrared. By using different materials that fluorescence under different radiation sources, the present invention allows for multiple methods to verify that an article is genuine. For example, if a paper contains lumen-loaded fibers, according to the present invention , that fluoresce under ultraviolet and it also contains similarly treated fibers that fluoresce under infrared, then it is quite possible that the counterfeiter will miss one of the fluorescences and make an imperfect copy.

It is apparent from the above that there exists a need in the art for an anti-counterfeit technique that is inexpensive, effective and hard to copy. Furthermore, the technique should not interfere with print characteristics of the substrate and the coating operations. It is the purpose of this invention to fulfill this and other needs in the art in a manner more apparent to the skilled artisan once given the following disclosure.

SUMMARY OF THE INVENTION

Generally speaking, this invention fulfills these needs by providing a method of producing and detecting an anti-counterfeit paper, comprising dissolving a soluble, fluorescent dye in a solvent, dewatering wood fibers having lumens to a solids content of up to 50% solids, mixing the dissolved fluorescent dye with the dewatered wood fibers such that the fluorescent agent is loaded into the lumens of the fibers, cleaning the loaded wood fibers to substantially remove any excess fluorescent dye located on the outside of the wood fiber lumens, sealing the dye substantially inside the lumens of the wood fiber, removing the fluorescent dye loaded wood fibers, drying the loaded wood fiber, adding the cleaned lumen loaded wood fibers to a papermaking pulp furnish at a rate to $Z_2$% of the total furnish, where $Z_2$ (ppm)= concentration of lumen loaded fibers in furnish=

$$Z_1 \times \frac{1\text{ ton}}{2000\text{ lbs}} \times 1{,}000{,}000$$

where $Z_1$=amount of lumen loaded fibers in furnish in lbs/ton of fiber, forming the lumen loaded furnish into an anti-counterfeit paper, and employing a radiation light source to detect the fluorescent dye in the lumen loaded fiber.

In certain preferred embodiments, the wood fibers are dewatered to a solids content of around 30% solids. Also, the loaded wood fibers are added to the papermaking pulp furnish at a rate of between a few parts per billion up to 20–25%.

In another further preferred embodiment, the introduction of the lumen loaded wood fibers into the papermaking pulp furnish produces an anti-counterfeit paper with fibers that will be recognizable under various ultraviolet radiations. In another further preferred embodiment, the radiation light will cause the fluorescence to occur in the visible range, i.e., be optically active.

A preferred method, according to this invention, offers the following advantages: ease of production of anti-counterfeit paper and excellent economy. In fact, in many preferred embodiments, these factors of ease of production and excellent economy are optimized to an extent that is considerably higher than heretofore achieved in prior, known methods.

DETAILED DESCRIPTION OF THE INVENTION

Wood fiber dyeing for the present invention is done "off line." Exemplary of such "off line" dyeing can be found in commonly assigned U.S. Pat. No. 5,759,349 ('349).

The present invention requires a strong bond between the dye and fibers so that the dye is not extractable and/or bleeds into the surrounding fibers in the final package. The dye must be such that it fluoresces under ultraviolet (or "black"), infrared light, or any other appropriate radiation to cause fluorescence. Equally, the dye can be any material that will glow or be recognizable when exposed to a radiation source, but is not readily distinguishable under normal conditions. A further embodiment of this invention would be to use several different types of dyed wood fibers. The fluorescent dye would be chosen such that several different colors would fluoresce under ultraviolet, infrared light or other appropriate light source.

In the paper industry, a class of dyes known as Optical Brighteners are suitable for this invention. These are discussed in the previously mentioned '349 patent. These compounds include stilbene and coumarin derivatives which will glow under ultraviolet or infrared light.

It is also important to estimate the concentration of lumen loaded materials in the anti-counterfeit paper. A step by step procedure for conducting this calculation is outlined below. For simplicity a single pine fiber was modeled as a cylinder. The inside of the cylinder contains the lumen loaded material and the cell wall, specific gravity 1.53 g/mL, accounts for the weight of the fiber. In order to make the most conservative estimate, the dimensions of the fiber were based on the minimum cell wall thickness and the maximum fiber diameter. The fiber has been assumed to be hollow cylinder with dimensions:

L=length of the fiber (cylinder)=45 mm;

d=external diameter of the fiber (cyliner)=1.5 $\mu$M;

S=thickness of the annulus=1.5 $\mu$M. Calculation Step 1 - Calculate volumes of inner cylinder, outer cylinder and annulus.

$V_{cylinder}=\pi R^2 L$ $V_{inner}=2.9\times10^{-12}m^3$ $V_{outer}=3.3\times10^{-12}m^3$ $V_{annuhus}=4.3\times10^{-13}m^3$ Step 2 Calculate amount of loaded material in one fiber. x (g) $=c_{L(g/m^3)}\times V_{inner}(m^3)$

- x=amount of dye in one fiber (convert to pounds)
- $c_l$L=concentration of lumen loaded solution Step 3 - Calculate the weight of an individual fiber. Assumption - the cell wall accounts for the total weight of a fiber.

$V_{annulus}(m^3)\div$density of cell wall$=1.5\times10^{-9}$lbs.$=7.5=10^{-13}$tons

- density of cell wall$=1.5\times10^{-4}m^3$/lb (*Commercial Timbers of the United States,* 1940; *p* 52) Step 4- Calculate amount of lumen loaded material in paperboard.

$$z_1\left(\frac{\text{lbs dye}}{\text{ton of paper}}\right) = x\left(\frac{\text{lbs dye}}{\text{loaded fiber}}\right) \times \frac{u}{1\times 10^6}\left(\frac{\text{loaded fibers}}{\text{total fibers}}\right) \times \frac{1\text{ fiber}}{7.5\times 10^{-13}\text{ tons}}$$

$$z_2(\text{ppm}) = z_1\left(\frac{\text{lbs dye}}{\text{ton}}\right) \times \frac{1\text{ ton}}{2000\text{ lbs}} \times 1{,}000{,}000$$

- u=concentration of loaded fobers in paperboard in ppm.
- $z_1$=amount of lumen loaded matial in paperboard in lbs./ton.
- $z_2$=concentration of lumen loaded material in paperboard in ppm.

Typically, dyed, lumen loaded wood fibers are added to the furnish such that they make up a small percentage of the total furnish. This percentage may be as low as a few parts per billion on up to 20–25%. In the preferred embodiment, the individual lumen loaded wood fibers will be recognizable under ultraviolet light or infrared light.

After the dyed, lumen loaded wood fibers are uniformly dispersed into the furnish, it is formed into anti-counterfeit paper by conventional papermaking operations.

The following example was prepared using the concepts of the present invention:

EXAMPLE

Fibers were loaded with various soluble fluorescent agents. These agents were each dissolved into a solvent, such as Methanol, at a concentration of 0.5 g/L, 1 g/L, and 10 g/L respectively. Pine was obtained and dewatered to 30% solids. Fifty dry grams were then added to 2 liters of each solution and conventionally agitated with electric stirrers for approximately 3 to 4 hours. This was done under a ventilation hood and during mixing Methanol was added to compensate for evaporation. Once the fibers were dyed they were washed over a vacuum with Methanol and water, alternately, until the resulting solution was clear. This required approximately two to three liters of each material. The fibers were repulped in a conventional laboratory disintegrator and four 12×12 inch hand sheets were made of them. The disintegrator is normally used in the paper industry to dispense fibers into an aqueous medium. Upon repulping it was noted that there was no visible change in the color of the water the fibers were dispersed in. The hand sheets were then dried on a conventional drum dryer thereby sealing the product into the fiber. Finally, the treated fibers were repulped and added to hardwood fiber at 100 ppm and 1000 ppm and 8 inch round hand sheets were produced.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A method of producing a radiation light source detectable, anti-counterfeit paper, wherein said method is comprised of the steps of:

dissolving a soluble fluorescent dye in a solvent;

dewatering wood fibers having lumens to a solids content of up to 50% solids;

mixing said dissolved fluorescent dye with said dewatered wood fibers such that said fluorescent dye is loaded into said lumens of said fibers;

cleaning said loaded wood fibers to substantially remove any excess fluorescent dye located on the outside of said wood fiber lumens;

sealing said fluorescent dye substantially inside said lumens of said wood fibers;

removing said fluorescent dye loaded wood fibers;

drying said loaded wood fibers;

incorporating said cleaned, lumen loaded wood fibers into a papermaking pulp furnish at a concentration of $Z_2$ of said total furnish, where $Z_2$ (ppm)=concentration of lumen loaded fibers in furnish=

$$Z_1 \times \frac{1\text{ ton}}{2000\text{ lbs}} \times 1{,}000{,}000$$

where $Z_1$=amount of lumen loaded fibers in furnish in lbs/ton of fiber wherein said cleaned, lumen loaded wood fibers are incorporated into said furnish at a concentration of between at least one parts per billion up to 25%;

forming said lumen loaded furnish into an anti-counterfeit paper; and wherein said fluorescent dye in said lumen loaded fibers can be detected by employing a radiation light source.

2. The method, as in claim 1, wherein said solvent is further comprised of:

Methanol.

3. The method, as in claim 1, wherein said wood fibers are dewatered to a solids content of less than 30% solids.

4. The method, as in claim 1, wherein said fluorescent dye is further comprised of:

an optically active dye.

5. The method, as in claim 1, wherein said radiation light source is further comprised of:

an infrared light.

6. The method, as in claim 1, wherein said radiation light source is further comprised of:

an ultraviolet light.

7. The method, as in claim 1, wherein said $Z_1$ or said amount of lumen loaded fibers in furnish in lbs/ton is estimated according to:

$$z_1\left(\frac{\text{lbs dye}}{\text{ton of paper}}\right) = x\left(\frac{\text{lbs dye}}{\text{loaded fiber}}\right) \times \frac{u}{1\times 10^6}\left(\frac{\text{loaded fibers}}{\text{total fibers}}\right) \times \frac{1\text{ fiber}}{7.5\times 10^{-13}\text{ tons}}$$

where u=concentration of loaded fibers in furnish in ppm, and where x=amount of dye in one fiber.

* * * * *